US007805971B2

(12) United States Patent
Cairo et al.

(10) Patent No.: US 7,805,971 B2
(45) Date of Patent: Oct. 5, 2010

(54) FORGING DIE AND PROCESS

(75) Inventors: Ronald Ralph Cairo, Greer, SC (US); Joseph Jay Jackson, Greer, SC (US); George Albert Goller, Greenville, SC (US); Raymond Joseph Stonitsch, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 221 days.

(21) Appl. No.: 11/856,111

(22) Filed: Sep. 17, 2007

(65) Prior Publication Data

US 2009/0133462 A1 May 28, 2009

(51) Int. Cl.
*B21J 5/00* (2006.01)

(52) U.S. Cl. ..... 72/354.2; 72/353.6

(58) Field of Classification Search ..... 72/352–359, 72/482.5, 465.1

See application file for complete search history.

(56) References Cited

U.S. PATENT DOCUMENTS

| | | | | |
|---|---|---|---|---|
| 6,484,552 | B1 * | 11/2002 | Bernas et al. | 72/402 |
| 6,531,002 | B1 * | 3/2003 | Henry et al. | 148/409 |
| 2003/0015016 | A1 * | 1/2003 | Anazawa et al. | 72/358 |
| 2004/0261486 | A1 * | 12/2004 | Kuhne | 72/353.6 |

* cited by examiner

*Primary Examiner*—Dana Ross
*Assistant Examiner*—Matthew G Katcoff
(74) *Attorney, Agent, or Firm*—Hartman & Hartman, P.C.; Gary M. Hartman; Domenica N. S. Hartman

(57) ABSTRACT

A forging die and process suitable for producing large forgings, including turbine disks and other rotating components of power-generating gas turbine engines, using billets formed by powder metallurgy. The forging die includes a backplate, and segments arranged in a radial pattern about a region on a surface of the backplate. Each segment has a backside facing the backplate and an interface surface facing away from the backplate, with the interface surface being adapted to engage the billet during forging. The segments are physically coupled to the surface of the backplate in a manner that enables radial movement of the segments relative to the backplate.

20 Claims, 2 Drawing Sheets

FORGING DIE AND PROCESS

BACKGROUND OF THE INVENTION

The present invention generally relates to forging equipment and processes, including those used in the production of large forgings from metal powders. More particularly, this invention relates to a forging die equipped with radial segments that reduce the incidence of cracking during forging of powder metallurgy billets by promoting radial growth during forging.

Rotor components for power generation turbines have typically been formed of iron and nickel-based alloys with low alloy content, i.e., three or four primary elements, which permit their melting and processing with relative ease and minimal chemical or microstructural segregation. Recently, wheels, spacers, and other rotor components of more advanced land-based gas turbine engines used in the power-generating industry, such as the H and FB class gas turbines of the assignee of this invention, have been formed from high strength alloys such as gamma double-prime (γ") precipitation-strengthened nickel-based superalloys, including Alloy 718 and Alloy 706. Typically processing of these components include forming ingots by triple-melting (vacuum induction melting (VIM)/electroslag remelting (ESR)/vacuum arc remelting (VAR)) to have very large diameters (e.g., up to about 90 cm), which are then billetized and forged. In contrast, rotor components for aircraft gas turbine engines are often formed by powder metallurgy (PM) processes, which are known to provide a good balance of creep, tensile and fatigue crack growth properties to meet the performance requirements of aircraft gas turbine engines. Powder metal components are typically produced by consolidating metal powders in some form, such as extrusion consolidation, then isothermally or hot die forging the consolidated material to the desired outline.

The use of powder metallurgy processes to produce large forgings suitable for rotor components of power-generating gas turbine engines provides the capability of producing more near-net-shape forgings, thereby reducing material losses. As more complex alloys such as Alloy 718 and beyond become preferred and the size of forgings continues to increase, the concerns of chemical and microstructure segregation, high material losses associated with converting large grained ingots to finish forgings, and limited industry capacity to process large, high strength forgings make the higher base cost PM alloys potentially more cost effective. However, problems encountered when forging powder metallurgy billets include high frictional forces that develop at the die-billet interface and impede free radial growth of the billet, resulting in cracks in the forging. These cracks, believed to be driven by tangential stresses, have been observed to be regularly spaced and in the radial direction at the Poisson-induced bugle in the forging during the upset process. Proposed solutions to this problem, including varying the forging die temperature, upset levels, and forging strain rates, have achieved only limited success.

BRIEF SUMMARY OF THE INVENTION

The present invention provides a forging die and process suitable for producing forgings, including turbine disks and other large rotating components of power-generating gas turbine engines. The invention is particularly well suited for producing large forgings from billets formed by powder metallurgy techniques.

According to a first aspect of the invention, the forging die includes a backplate having a first surface, and a plurality of segments arranged in a radial pattern about a region on the first surface of the backplate. Each of the segments has a backside facing the backplate and defines an interface surface facing away from the backplate, with the interface surface being adapted to engage a billet during forging of the billet with the forging die. The segments are physically coupled to the first surface of the backplate in a manner that enables radial movement of the segments relative to the region of the backplate.

According to a second aspect of the invention, the forging process entails assembling a forging die by arranging a plurality of segments in a radial pattern about a region on a first surface of a backplate and physically coupling the segments to the first surface to enable radial movement of the segments relative to the region of the backplate. The segments are arranged and coupled to the backplate so that each segment has a backside facing the backplate and defines an interface surface facing away from the backplate, with the interface surface being adapted to engage a billet during forging of the billet with the forging die. A billet is then forged with the forging die by engaging and working the billet with the interface surfaces of the segments.

Significant advantages of the forging die and process of this invention include the ability to forge powder metallurgy billets to produce large disks and other large articles with a lower incidence of cracking and the ability to achieve more uniform properties in such articles. Reduced incidence of cracking is able to achieve a corresponding reduction in scrappage, while reduced variance in properties results in higher design allowable properties, hence more efficient article designs. The die and process also enable the forging of large articles from alloys that might otherwise have been previously unsuited or otherwise difficult to forge.

Other objects and advantages of this invention will be better appreciated from the following detailed description.

DETAILED DESCRIPTION OF THE INVENTION

The present invention is directed to the manufacture of components formed by forging, a particular example being the forging of large billets to form rotor components of land-based gas turbine engines, though other applications are foreseeable and within the scope of the invention. In a preferred embodiment, the billets are formed by a powder metallurgy process, such as by consolidating (e.g., hot isostatic pressing (HIP) or extrusion consolidation) a metal alloy powder. A variety of alloys can be used for this purpose, including low-alloy iron and nickel-based alloys, as well as higher strength alloys such as gamma double-prime precipitation-strengthened nickel-based superalloys including Alloy 718 and Alloy 706.

Figure 1:
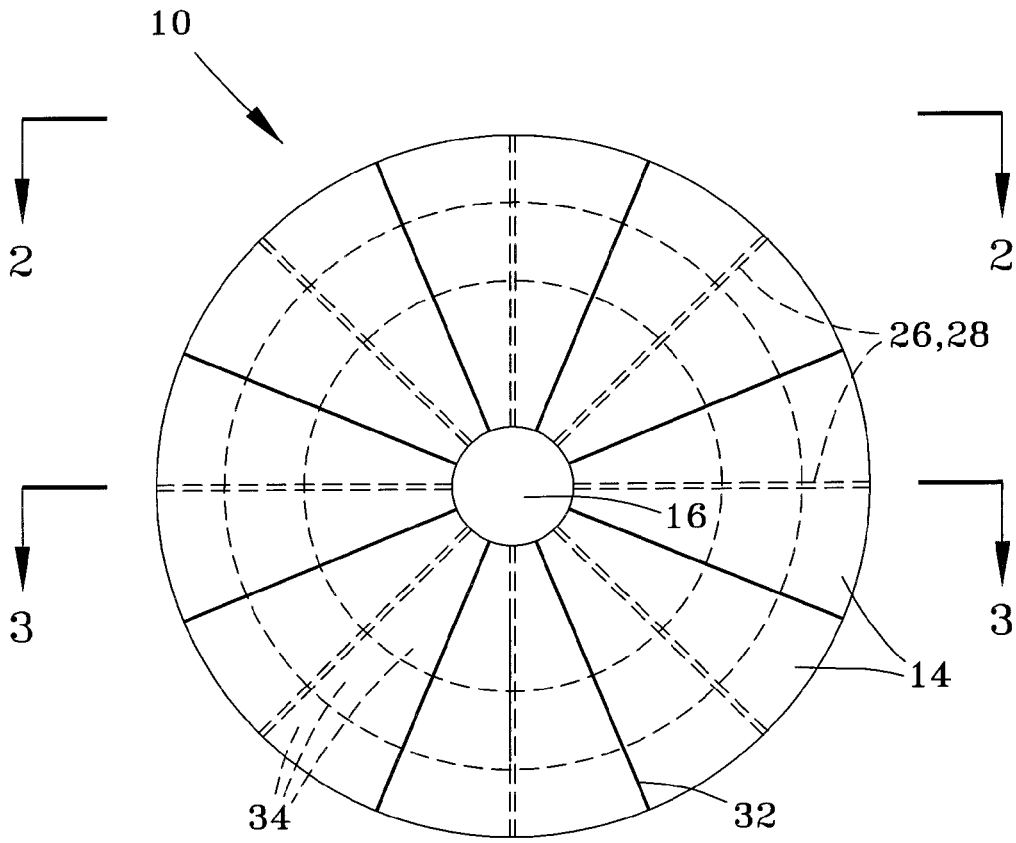
FIG. 1 is a schematic representation showing a plan view of a forging die in accordance with an embodiment of the present invention.
Figure 2:
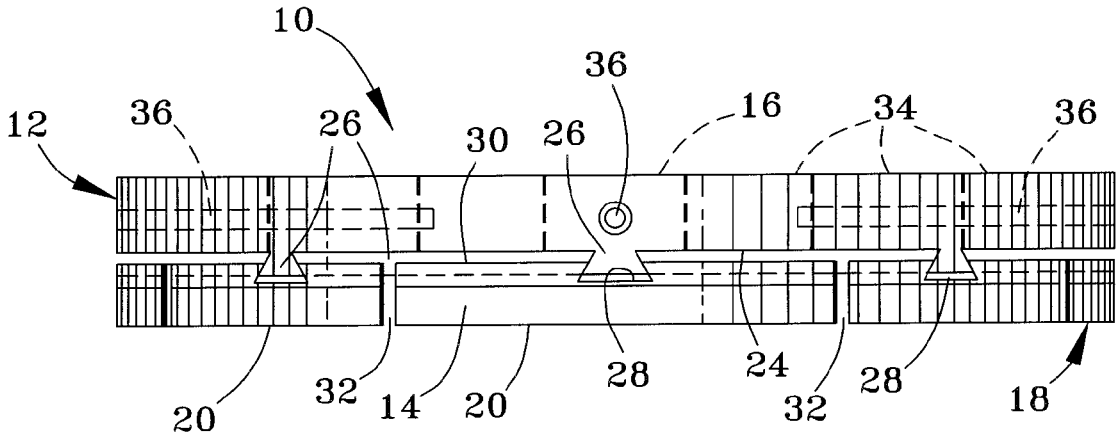
FIGS. 2 and 3 are schematic representations showing views along lines 2-2 and 3-3, A-A and B-B, respectively, of FIG. 1.
Figure 3:
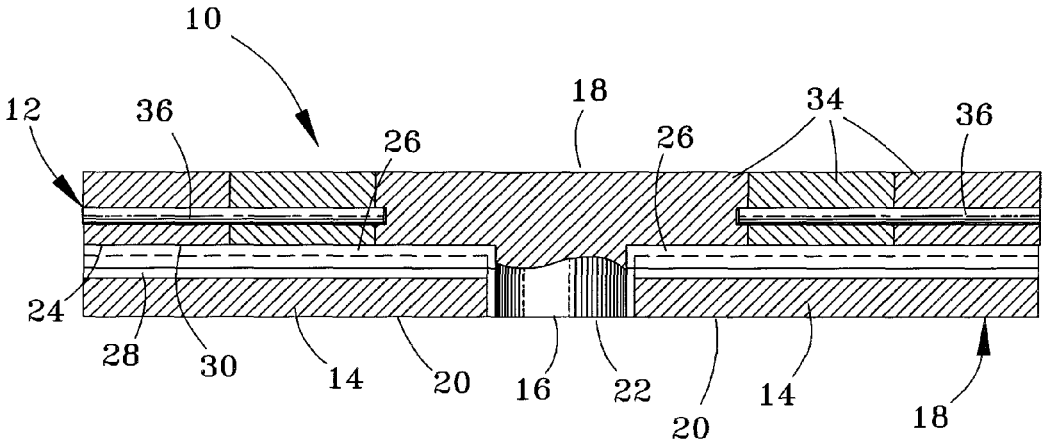
Figure 4:
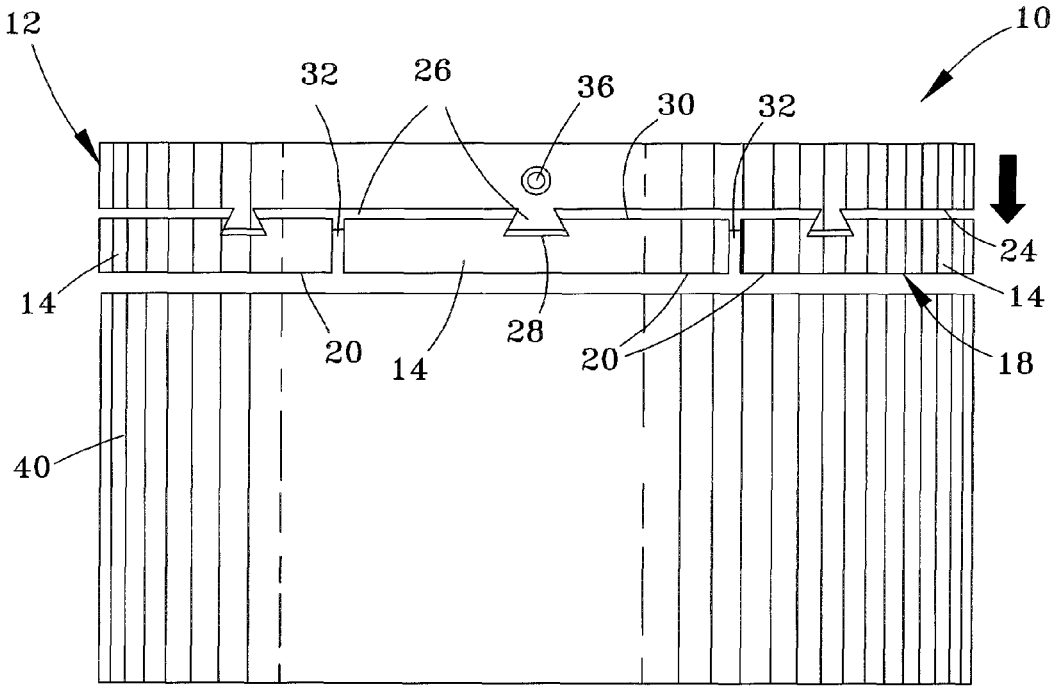
FIG. 4 is a schematic representation corresponding to the view in FIG. 2, and shows the forging die of FIGS. 1 through 3 prior to initiating a forging operation on a billet.

FIGS. 1 through 4 represent a forging die 10 made up of an assembly of individual components, including a backplate 12 and segments 14 arranged in a radial pattern about a central region 16 of the backplate 12. The surfaces 20 and 22 of the segments 14 and central region 16, respectively, cooperate to define an interface surface 18 with which material forged by the die 10 is deformed. As seen in FIG. 3, the surface 22 of the central region 16 is substantially flush with the surrounding surfaces 20 of the individual segments 14, though it is foreseeable that these surfaces 20 and 22 might not be coplanar.

The segments 14 are seen in FIG. 1 as being essentially identical in size and having essentially identical wedge shapes, though different sizes and shapes are also within the scope of the invention. The radially innermost extent of each segment 14 is shown as abutting the central region 16, while the radially outermost extent of each segment 14 is shown as coinciding with the radially outermost extent of the backplate 12. As evident from FIG. 2, a radial gap 32 exists between the adjacent radial edges of each adjacent pair of segments 14.

As more readily evident from FIGS. 2 and 3, the segments 14 are coupled to the backplate 12 but adapted for radial movement relative to the backplate 12 as a result of the backplate 12 and segments 14 having complementary guide features. In the embodiment shown, the surface 24 of the backplate 12 facing the segments 14 has radially-oriented rails or splines 26 that extend between the central region 16 and perimeter of the backplate 12. The splines 26 can be integrally-formed raised features on the surface 24 of the backplate 12, or separately manufactured and installed on the backplate 12. As evident from FIG. 2, the splines 26 are sized and shaped to be individually received in grooves 28 defined in the backside 30 of each segment 14. The splines 26 and grooves 28 are shown as having complementary-shaped dovetail cross-sections that prevent the segments 14 from being removed from the backplate 12 in a direction normal to the surface 24 of the backplate 12, yet permit free radial movement of the segments 14 on the backplate 12 such that the splines 26 serve as radial guides for the segments 14. While dovetail cross-sections are shown for the splines 26 and grooves 28, other interlocking cross-sections could also be used and are within the scope of this invention.

The backplate 12 is also preferably constructed of individual components in the form of concentric bands 34 surrounding the central region 16 of the backplate 12. The bands 34 are secured together by radial pins 36 inserted through holes in the outermost band 34, through aligned holes in the inner band(s) 34, and into the central region 16 of the backplate 12. While each of the bands 34 is represented as having an annular or ring shape, other shapes are also within the scope of the invention. With this construction, each band 34 is preferably manufactured or otherwise equipped to carry a portion of each spline 26, and proper circumferential alignment of the bands 34 results in individual aligned splines 26, each made up of the spline portions on the bands 34.

With the above construction, the segments 14 are free to move in the radial direction (relative to the region 16) to coincide with and accommodate the radial motion of a material being deformed during a forging process in which the die 10 is used. In other words, during a forging cycle in which a material, such as a billet (40 in FIG. 4), is being deformed by the die 10, radially outward flow of the deformed material is automatically assisted by the simultaneous radially outward travel of the segments 12, with the result that the incidence of cracking of the forging can be reduced by promoting—instead of frictionally inhibiting—radial growth of the billet material during forging. Because forging operations are typically performed in stages (i.e., partial upsets/stages), with each successive stage further deforming the material to increase its width or diameter, the concentric bands 34 of the backplate 12 can be added and removed as necessary to accommodate the increasing size of the forging. Multiple sets of segments 14 can be provided to match the different diameters of the backplate 12 achieved by varying the number of bands 34.

From the foregoing, it should be understood that the forging die 10 is not limited to installation on any particular type of forging ram, but is generally intended to be adapted for installation on a wide variety of forging equipment. In use, the forging die 10 is first assembled to contain the desired number of bands 34 for the backplate 12 and segments 14 of appropriate number and size for the particular material to be forged. As is well understood by those skilled in the art, dimensions and physical and mechanical properties required for the die 10 and its components will also depend on the material being forged. In general, suitable materials for the backplate 12 and segments 14 include conventional tool steels and nickel alloys for improved durability, though other materials are also possible. When forging nickel-based alloys to produce turbine disk forgings, tool steels and nickel alloys are both suitable as materials for the backplate 12 and segments 14.

Billets suitable for forging a turbine disk can be produced according to various known practices. In a particular embodiment of the invention, in which the billet 40 is produced by powder metallurgy, the starting powder material can be produced from a melt whose chemistry is that of the desired alloy. This step is typically accomplished by VIM processing, but could also be performed by adaptation of ESR or VAR processes. While in the molten condition and within chemistry specifications, the alloy is converted into powder by atomization or another suitable process to produce generally spherical powder particles. The powder is then placed and sealed in a can, such as a mild steel can, whose size will meet the billet size requirement after consolidation. Thereafter, the can and its contents are consolidated at a temperature, time, and pressure sufficient to produce a dense consolidated billet 40. Consolidation can be accomplished by hot isostatic pressing (HIP), extrusion, or another suitable consolidation method.

Prior to forging, the interface surface 18 of the die 10 is preferably lubricated with a high temperature lubricant, such as a glass slurry of a type known in the art, for example, a slurry containing molybdenum disulfide ($MoS_2$), to promote sliding between the interface surface 18 and the billet 40. The same or different lubricant may also be applied between the splines 26 and grooves 28 to facilitate movement of the segments 14 on the backplate 12. The billet 40 can then be forged with the die 10 of this invention according to known procedures, such as those currently utilized to produce disk forgings for large industrial turbines, though possibly modified to take advantage of the radial movement of the segments 14 during each forging stage, as well as any adjustments to the size of the die 10 made possible by the concentric bands 34 of the backplate 12. In general, the forging operation is preferably performed at temperatures and under loading conditions that allow complete filling of the finish forging die cavity, avoid fracture, and produce or retain a uniform desired grain size within the material. For this purpose, forging is typically performed under superplastic forming conditions to enable filling of the forging die cavity through the accumulation of high geometric strains.

While the invention has been described in terms of particular processing parameters and compositions, the scope of the invention is not so limited. Instead, modifications could be adopted by one skilled in the art, such as altering the configuration of the die 10, using the die 10 to forge billets formed by various processes and from various alloys, substituting other processing steps, and including additional processing steps. Accordingly, the scope of the invention is to be limited only by the following claims.

The invention claimed is:

1. A forging die comprising:

a backplate comprising a region and a plurality of concentric members that surround the region and are releasably coupled to each other, the concentric members defining a first surface of the backplate;

a plurality of segments arranged in a radial pattern about the region on the first surface of the backplate, each of the segments having a backside surface facing the backplate and an oppositely-disposed interface surface facing away from the backplate, the interface surface of each segment being adapted to engage a billet during forging of the billet with the forging die; and means for physically coupling the segments to the first surface of the backplate to enable radial movement of the segments relative to the region of the backplate.

2. A forging die comprising:

a backplate having a first surface;

a plurality of segments arranged in a radial pattern about a region on the first surface of the backplate, each of the segments having a backside surface facing the backplate and an oppositely-disposed interface surface facing away from the backplate, the interface surface of each segment being adapted to engage a billet during forging of the billet with the forging die; and means for physically coupling the segments to the first surface of the backplate to enable radial movement of the segments relative to the region of the backplate, wherein the coupling means comprises, for each of the segments, a first radial guide feature on the first surface of the backplate and a complementary second radial guide feature on the backside surface of the segment, and the first and second radial guide features permit only radial movement of the segments on the backplate and prevent uncoupling of the segments from the backplate in a direction normal to the first surface of the backplate.

3. The forging die according to claim 2, wherein each of the first radial guide features is a raised surface feature on the first surface of the backplate and each of the second radial guide features is a groove on the backside surface of a corresponding one of the segments, the grooves interlocking with the raised surface features to permit only radial movement of the segments on the backplate and prevent uncoupling of the segments from the backplate in a direction normal to the first surface of the backplate.

4. The forging die according to claim 1, wherein the region around which the segments are arranged is centrally located on the backplate.

5. The forging die according to claim 1, wherein all of the segments are of approximately equal size and shape.

6. The forging die according to claim 1, wherein the segments are wedge-shaped and increase in width in a radial direction away from the region of the backplate.

7. The forging die according to claim 1, wherein each of the segments has oppositely-disposed radial edges and are arranged on the backplate so that the radial edges of each segment are adjacent the radial edges of immediately adjacent segments.

8. The forging die according to claim 7, wherein a radial gap is present between adjacent radial edges of immediately adjacent segments.

9. The forging die according to claim 1, wherein the region of the backplate defines a surface that is approximately flush with immediately adjacent portions of the interface surfaces of the segments.

10. The forging die according to claim 2, wherein the backplate is an assembly comprising the region of the backplate and a plurality of concentric members surrounding the region, the concentric members defining the first surface of the backplate.

11. The forging die according to claim 10, wherein the concentric members are releasably coupled to each other.

12. A forging process comprising:

assembling a forging die by arranging a plurality of segments in a radial pattern about a region on a first surface of a backplate and physically coupling the segments to the first surface to enable radial movement of the segments relative to the region of the backplate, each of the segments having a backside surface facing the backplate and an oppositely-disposed interface surface facing away from the backplate, the interface surface being adapted to engage a billet during forging of the billet with the forging die; and forging a billet with the forging die by engaging and working the billet with the interface surfaces of the segments to produce a forging, wherein during a cycle of the forging step the billet is deformed by the die and radially outward flow of deformed material of the billet is assisted by the simultaneous radially outward travel of the interface surfaces of the segments which contact the deformed material of the billet and reduce the incidence of cracking of the forging by promoting radial growth of the deformed material during the forging step.

13. The process according to claim 12, wherein the segments are coupled to the backplate to permit only radial movement of the segments on the backplate and prevent uncoupling of the segments from the backplate in a direction normal to the first surface of the backplate.

14. The process according to claim 12, wherein the assembling step further comprises assembling the backplate by concentrically arranging a plurality of members surrounding the region, the concentric members defining the first surface of the backplate.

15. A forging process comprising:

assembling a backplate by concentrically arranging a plurality of members surrounding a region of the backplate and releasably coupling the concentric members to each other to define a first surface of the backplate;

assembling a forging die by arranging a plurality of segments in a radial pattern about the region on the first surface of the backplate and physically coupling the segments to the first surface to enable radial movement of the segments relative to the region of the backplate, each of the segments having a backside surface facing the backplate and an oppositely-disposed interface surface facing away from the backplate, the interface surface being adapted to engage a billet during forging of the billet with the forging die; and forging a billet with the forging die by engaging and working the billet with the interface surfaces of the segments.

16. The process according to claim 15, wherein the forging step comprises multiple stages, and at least one of the concentric members is either coupled to or uncoupled from the backplate between successive stages of the multiple stages.

17. The process according to claim 12, wherein the billet is formed by a powder metallurgy process.

18. The process according to claim 12, wherein the billet is formed by consolidation of a powder of a metal alloy.

19. The process according to claim 18, wherein the metal alloy is a nickel-based superalloy.

20. The process of claim 12, wherein the forging step produces a turbine disk of a gas turbine engine.

* * * * *